United States Patent [19]

Ritter

[11] 4,227,504

[45] Oct. 14, 1980

[54] LIMITATION APPARATUS FOR FULL-LOAD INJECTION QUANTITY IN A SUPERCHARGED INTERNAL COMBUSTION ENGINE WITH FUEL INJECTION

[75] Inventor: Ernst Ritter, Stuttgart, Fed. Rep. of Germany

[73] Assignee: Robert Bosch GmbH, Stuttgart, Fed. Rep. of Germany

[21] Appl. No.: 945,277

[22] Filed: Sep. 25, 1978

[30] Foreign Application Priority Data

Oct. 20, 1977 [DE] Fed. Rep. of Germany ..... 2747083

[51] Int. Cl.[3] ..... F02D 1/06

[52] U.S. Cl. ..... 123/380; 123/383

[58] Field of Search ..... 123/140 MP, 140 MC, 123/139 ST

[56] References Cited

U.S. PATENT DOCUMENTS

| | | | |
|---|---|---|---|
| 2,233,035 | 2/1941 | Schweizer et al. | 123/140 MP |
| 4,015,573 | 4/1977 | Okura et al. | 123/140 MP |
| 4,085,724 | 4/1978 | Djordjevic et al. | 123/140 MP |
| 4,086,898 | 5/1978 | Kriz | 123/140 MP |

FOREIGN PATENT DOCUMENTS

| | | | |
|---|---|---|---|
| 1121762 | 8/1956 | France | 123/140 MP |
| 763027 | 12/1956 | United Kingdom | 123/140 MC |

*Primary Examiner*—Ira S. Lazarus
*Assistant Examiner*—Magdalen Moy
*Attorney, Agent, or Firm*—Edwin E. Greigg

[57] ABSTRACT

An apparatus is proposed for the limitation of the full-load injection quantity in a supercharged, internal combustion engine with fuel injection, which serves to effect the charge-pressure-dependent and atmospheric-pressure-dependent limitation of the full-load injection quantity. The apparatus comprises two pneumatic control elements which act upon a single, automatically disengageable full-load stop via deflecting elements in order to attain a starting quantity. The one control element which responds to the pressure differential between charge and atmospheric pressure, independently of the other control element which serves to effect the atmospheric-pressure-dependent limitation of the full-load injection quantity, engages a bearing member of the full-load stop which is guided parallel to the supply quantity adjustment member of the injection pump and thus enables a correction of the full-load quantity and an automatic control of the additional starting quantity which is not influenced by the position of the pressure-dependent control element, independently of atmospheric pressure.

12 Claims, 2 Drawing Figures

LIMITATION APPARATUS FOR FULL-LOAD INJECTION QUANTITY IN A SUPERCHARGED INTERNAL COMBUSTION ENGINE WITH FUEL INJECTION

BACKGROUND OF THE INVENTION

The invention relates to an apparatus for the limitation of the full-load injection quantity in a supercharged internal combustion engine with fuel injection, with two pneumatic control elements, wherein one control element responds to the pressure differential between charge and atmospheric pressure to effect a charge-pressure-dependent limitation of the full-load injection quantity, and another control element embodied as a barometric cell is arranged to limit the full-load injection quantity in dependence on atmospheric pressure and both control elements act on the supply quantity adjustment member of the injection pump, and with at least one full-load stop which is disengageable for the attainment of an additional starting quantity which is greater than the full-load injection quantity.

The object of such an apparatus is to limit the full-load injection quantity of a supercharged internal combustion engine with fuel injection which is used to drive road vehicles in regions with extreme variations in elevation, in order to avoid smoke formation as a result of adapting to the load and atmospheric-pressure-dependent weight of the air charge of the cylinders.

A known apparatus of this type comprises two full-load stops which are associated with the regulator rod of the injection pump, one of which is controlled by a control element responsive to the differential between charge pressure and atmospheric pressure and the other is controlled by a control element which is embodied as a barometric cell.

These two full-load stops are each arranged on one regulator nose, in the regulator rod adjustment direction of minimum quantity, in such a way that the full-load injection quantity, up to a preset differential between charge pressure and atmospheric pressure, is limited independently of the charge pressure in accordance with the full-load stop controlled thereby and, beyond that preset pressure differential, independently of atmospheric pressure alone, by means of the full-load stop controlled by the barometric cell. So that the regulator rod can be brought into the starting quantity position to start the engine, both full-load stops must be arranged to be disengaged. Since each of the full-load stops further requires a separate disengagement actuation, which can either take place by means of the rpm transmitter of the regulator apparatus when the engine rpm fall below the minimum idling level, or by means of a hydraulic or electromagnetic control element, either automatically or by hand via a cable line or a rod, the known apparatus described above proves to be extraordinarily expensive, not only in cost to construct but time and effort to install.

OBJECT AND SUMMARY OF THE INVENTION

The arrangement according to the present invention has the advantage over the earlier devices in that it reduces the requisite expense for an apparatus of the known type, and a clean separation takes place between the charge-pressure-dependent and atmospheric-pressure-dependent limitation of the full-load injection quantity. Furthermore, an automatically controllable setting of the full-load stop is possible which allows the attainment of an additional quantity when the motor is started, without supplementary control means and control elements.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
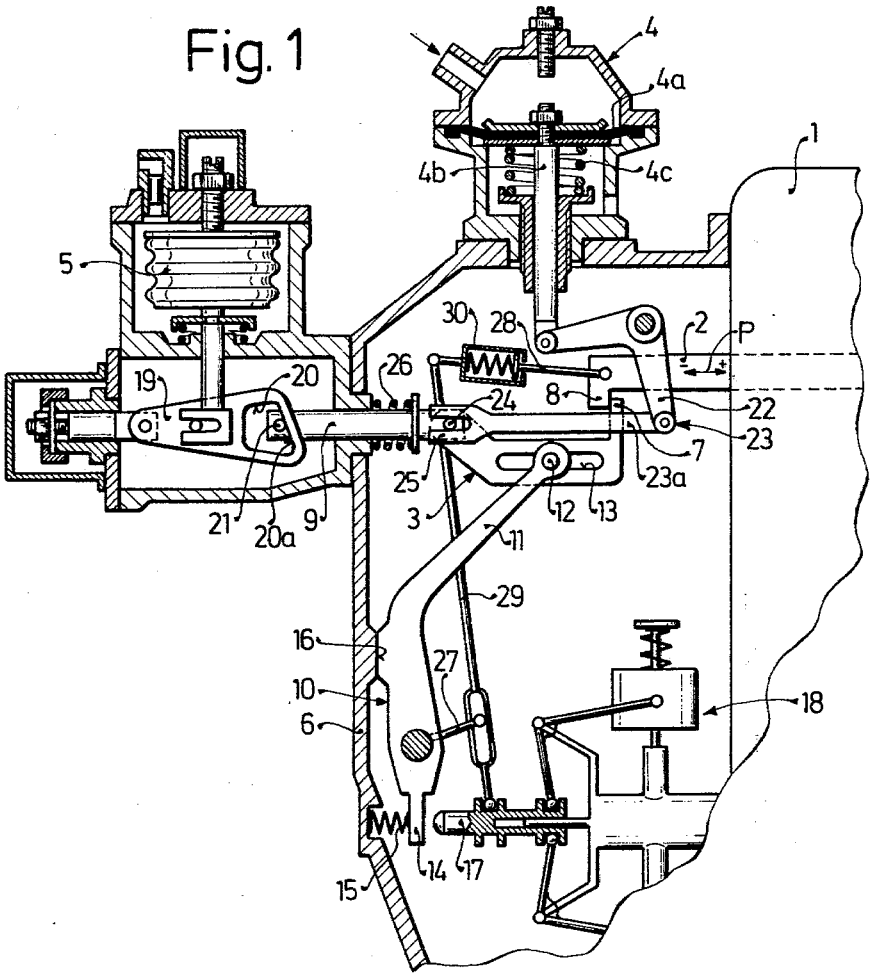
FIG. 1 generally shows a cross-sectional view of an rpm regulator equipped with the apparatus according to the invention.

In the fuel injection pump for a supercharged internal combustion engine with fuel injection, which is indicated in the drawing by reference numeral 1, a full-load stop 3 is provided which limits the path of a regulator rod 2, the latter being adapted to serve as the supply quantity adjustment member, in the direction of setting an additional quantity. The full-load stop 3 is alternatively controlled by a control element 4, which is responsive to the differential between charge pressure and atmospheric pressure, and by a control element 5, which is embodied as a barometric cell, so that the full-load injection quantity may be adapted to the weight of the air charge of the cylinders, which is dependent both on charge pressure and on atmospheric pressure.

The full-load stop 3, which is arranged in a regulator housing 6 made by a flanging of the injection pump 1 and which cooperates with a counterstop nose 8 on the regulator rod 2 by means of a stop nose 7, is embodied as disengageable so that the regulator rod 2 can be brought into the starting-quantity position in order to start the engine, and for this purpose the full-load stop 3 is swingably fixed on a bearing member 9 which is guided parallel to the regulator rod 2.

A two-armed crank 10 is fixed in the regulator housing 6 and is provided on its arm 11 at one end with a tang 12 which projects into an oblong slotted recess 13 and the other end of the arm 11 is held by a pressure spring 15 which engages its stub portion 14 as in the position of rest shown in FIG. 1, and in which position the arm 11 contacts a stop face 16 that is provided on the regulator housing 6 and thus maintains the full-load stop 3 in the stop position shown.

The crank 10 is urged with its stub portion 14 generally in the direction of force of the pressure spring 15 which advances it toward a governor sleeve 17 of a centrifugal rpm transmitter 18 of the rpm regulator (shown in simplified form in FIG. 1) in such a way that it is swung in a clockwise direction out of the illustrated rest position by the above means as they follow their path out of the illustrated idling position into the final position taken when the engine stops. Thus the crank 10 diverts the stop nose 7 of the full-load stop 3 out of its stop position which limits the path of the counterstop nose 8, by which means the regulator rod 2 can be brought, in the positive direction of the arrow P, into the starting-quantity position in order to start the engine.

The control elements 4 and 5 contact the bearing member 9 of the full-load stop 3, which is guided parallel to the regulator rod 2, indirectly in such a way that the full-load stop 3 is controlled either independently of both charge and atmospheric pressure by the control element 4 which is responsive to the differential between charge pressure and atmospheric pressure, or independently of atmospheric pressure alone by the control element 5 which is embodied as a barometric cell. Both control elements 4 and 5 are equipped with deflecting elements in such a way that only the one control element 4 or 5 which determines the lowest full-load injection quantity at that time limits the position of the full-load stop 3.

Thus, the control element 5, which is a barometric cell, acts upon the full-load stop 3 via a swing-controlled plate 19, which is provided adjacent to one end with a cam recess 20 which serves as a deflecting element. An inner edge of this cam recess 20 includes a curved track 20*a*, which limits the motion of the regulator rod 2 in the additional-quantity direction and is arranged to engage only one side of a coupler tang 21 that is provided on the bearing member 9 of the full-load stop 3 and thus does not prevent the movement of this tang 21 in the minimum-quantity direction (the minus direction of the arrow P).

The control element 4 which is responsive to the pressure differential between charge and atmospheric pressure contains a diaphragm 4*a*, the control rod 4*b* of which is associated with the full-load stop 3 and opposes the force of a return guide spring 4*c* and also opposes atmospheric pressure via an actuating element 23 which is formed by a bell crank 22 fixed in the regulator housing 6 and a push rod 23*a* articulated thereupon. The push rod 23*a* rests in the minimum-quantity direction of the regulator rod 2 on a bearing bolt or coupler tang 24 provided for the full-load stop 3 on the bearing member 9 and engages the bearing bolt 24 with a bifurcated jaw 25 which serves as the second deflecting element, and which bifurcated jaw 25 thus permits a movement of the full-load stop 3, controlled by the control element 5, in the direction of a lower full-load position than that controlled by the control element 4.

A pressure spring 26, the adjustment for which is clearly shown in FIG. 1, acts upon the bearing member 9 in the additional-quantity direction of the regulator rod 2 (the positive direction of the arrow P), which spring 26 serves to compensate for the play between full-load stop 3 and the control element 4 or 5 which is engaged at a given time.

The actuation of the regulator rod 2 by the centrifugal rpm transmitter 18 and by an arbitrarily actuatable setting element 27 is carried over in a known manner via a link means 28 of an intermediate lever 29 which is coupled with the governor sleeve 17 and thus embodied as a rocker arm. Further, there is an accumulator 30 that cooperates with said link means 28 with the accumulator arranged to permit a lower full-load setting of the regulator rod 2 controlled by the control elements 4 and 5 than the full-load setting previously provided by the position of the setting element 27 and the governor sleeve 17. The accumulator 30 may also be arranged in a known fashion at another point of the regulator linkage, such as on the governor sleeve 17.

Figure 2:
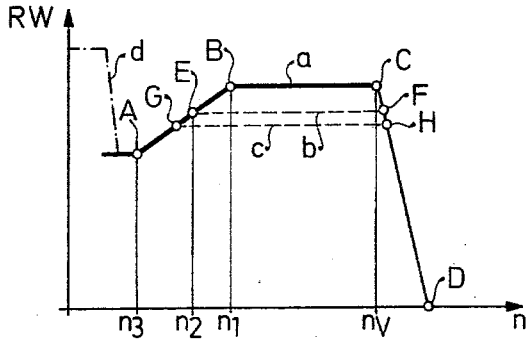
FIG. 2 is a diagram which illustrates the mode of operation of the apparatus.

The diagram shown in FIG. 2 serves to explain the mode of operation of the apparatus in accordance with the invention as described in connection with FIG. 1. The diagram shows full-load regulator path curves a, b, and c, in which the regulator path RW is plotted with respect to the rpm n. The continuously extended full-load curve a extends between the points A-B-C and D, where C-D represents the characteristic curve for the highest permissible full-load regulator path between the rpm values $n_1$ and $n_v$ at normal air pressure—that is, when the engine is operated approximately at sea level; and A-B is controlled by means of the control element 4 which is actuated in accordance with the charge pressure of the engine. When the engine is operated at high elevations, the full-load fuel quantity to be injected is adapted to the charge air of the cylinder, which naturally grows worse because of the decreasing air pressure, by the following means: The control element 5 which operates in dependence on atmospheric pressure takes the characteristic curve B-C for the maximal permissible full-load fuel quantity back to the curve b, represented in dashed lines, between the points E and F. Then the shutoff takes place from F toward D and between the points E and A; that is, between the rpm values of $n_2$ and $n_3$ the pressure-dependent control member 4 again determines the maximal permissible fuel quantity. At a still lower air pressure, the control element 5 limits the full-load characteristic curve in accordance with the curve c shown in dashed lines between points G and H, whereby the curve segment G-A is again controlled by control element 4.

The additional quantity for starting which is automatically directed independently of the functioning of the control elements 4 and 5 is indicated by the dashed-line curve d and is made possible, as has already been described, by means of the swiveling of the two-armed crank 10 and the full-load stop 3 that is controlled by the governor sleeve 17 when the engine stops.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An apparatus for the limitation of the full-load injection quantity in a supercharged internal combustion engine with fuel injection including an injection pump having a supply quantity adjustment member, with two pneumatic control elements, one control element responds to the pressure differential between charge and atmospheric pressure to effect a charge-pressure-dependent limitation of the full-load injection quantity, and another control element embodied as a barometric cell is arranged to limit the full-load injection quantity in dependence on atmospheric pressure and both control elements act on said supply quantity adjustment member of said injection pump, and with a full-load stop which is disengageable for the attainment of an additional starting quantity which is greater than the full-load injection quantity, further wherein each of said control elements acts at least indirectly via deflecting elements on said full-load stop independently of one another and alternately relieving each other so that only one of said control elements determines the maximal full-load setting of said full-load stop for said supply quantity adjustment member of said injection pump and means disengaging said full-load stop when the engine rpm value.

2. An apparatus in accordance with claim 1, further wherein each of said control elements are arranged to cooperate through linkage means which include said deflecting elements with a bearing member having end portions and arranged to urge said supply adjustment member toward minimum-quantity injection.

3. An apparatus in accordance with claim 2, further wherein said deflecting elements are disposed at the end portions of said bearing member.

4. An apparatus in accordance with claim 3, further wherein said bearing member is in a plane parallel to said supply quantity adjustment member.

5. An apparatus in accordance with claim 2, further wherein one of said control elements is associated with said bearing member through a pivotally mounted cam plate which forms a part of said linkage means.

6. An apparatus in accordance with claim 3, further wherein one of said deflecting elements comprises a pivotally disposed cam plate.

7. An apparatus in accordance with claim 1, further wherein at least one of said control elements comprises a barometric cell.

8. An apparatus in accordance with claim 2, further wherein the end portions of said bearing member are provided with offstanding tang means and at least one element of said linkage means includes a cam track arranged to engage one of said tang means.

9. An apparatus in accordance with claim 5, further wherein another one of said control elements is associated with said bearing member through a bell crank and a push rod, each of said last-named elements forming a part of said linkage means.

10. An apparatus in accordance with claim 2, further wherein each of said portions of said bearing member includes tang means and said linkage means includes an element that engages one of said tang means.

11. An apparatus in accordance with claim 2, further wherein said bearing member is urged in a direction toward said supply quantity adjustment member by a pressure spring means.

12. An apparatus in accordance with claim 11, further wherein said pressure spring means serves to compensate for the play between said full-load stop and each of said two control elements.

* * * * *